US011399607B2

(12) United States Patent
Kelsch et al.

(10) Patent No.: US 11,399,607 B2
(45) Date of Patent: Aug. 2, 2022

(54) RETRACTABLE NECKLACE TRAVEL SCROLL

(71) Applicants: Carrie K. Kelsch, Herriman, UT (US); Ryan J. Humphreys, Herriman, UT (US); David K. Kelsch, Herriman, UT (US); Jean B. Kelsch, Herriman, UT (US)

(72) Inventors: Carrie K. Kelsch, Herriman, UT (US); Ryan J. Humphreys, Herriman, UT (US); David K. Kelsch, Herriman, UT (US); Jean B. Kelsch, Herriman, UT (US)

( * ) Notice: Subject to any disclaimer, the term of this patent is extended or adjusted under 35 U.S.C. 154(b) by 92 days.

(21) Appl. No.: 16/987,392

(22) Filed: Aug. 6, 2020

(65) Prior Publication Data

US 2021/0127807 A1 May 6, 2021

Related U.S. Application Data

(60) Provisional application No. 62/883,226, filed on Aug. 6, 2019.

(51) Int. Cl.

| | |
|---|---|
| ***A45C 11/04*** | (2006.01) |
| ***A45C 11/16*** | (2006.01) |
| ***A47F 7/02*** | (2006.01) |
| ***G09F 5/02*** | (2006.01) |
| ***A45C 7/00*** | (2006.01) |

(52) U.S. Cl.

CPC ..... *A45C 11/16* (2013.01); *A45C 7/0077* (2013.01); *A47F 7/02* (2013.01); *G09F 5/02* (2013.01)

(58) Field of Classification Search

CPC ..... A45C 7/0077; A45C 11/16; A47F 7/02; A47F 5/0006; G06F 5/02; E06B 9/42; E06B 9/78

USPC ..... 206/6.1, 493, 495, 806; 211/85.2, 113; 160/24, 120, 250, 313

See application file for complete search history.

(56) References Cited

U.S. PATENT DOCUMENTS 4,118,066 A * 10/1978 Ricke ..... B60J 11/025 296/136.03
4,413,665 A * 11/1983 Corcoran ..... E06B 9/50 160/315
4,487,244 A * 12/1984 Olson ..... E06B 9/60 160/238
4,514,725 A * 4/1985 Bristley ..... G08B 7/064 340/531
4,790,592 A * 12/1988 Busso ..... B60N 2/6027 297/184.11

(Continued)

*Primary Examiner* — Luan K Bui
(74) *Attorney, Agent, or Firm* — Workman Nydegger

(57) ABSTRACT

A retractable display, storage and carrying case for necklaces includes an inverted-V-shaped frame, a torsion-spring-loaded tube rotatably suspended between the frame, a rectangular cloth sheet attached along one edge to the tube, with an opposite edge wrapped around a weighted rod to form a pocket on a front surface of the sheet. A plurality of jewelry hanging hooks are secured to an upper portion of the cloth sheet. One end of a necklace is attached to a single hanging hook, while the opposite end is tucked into the pocket. Much like a roll-up blind, the cloth sheet can be extended to a desired length by tugging on the weighted rod. Another tug will cause the roll-up mechanism to release and wind up the cloth sheet around the tube.

7 Claims, 10 Drawing Sheets

(56) References Cited

U.S. PATENT DOCUMENTS

| | | | | |
|---|---|---|---|---|
| 5,209,344 | A * | 5/1993 | Smith | A45C 11/16 206/6.1 |
| 5,427,230 | A * | 6/1995 | Mattox | A45C 11/16 206/6.1 |
| 7,389,868 | B2 * | 6/2008 | Lewand | A47G 1/12 206/6.1 |
| 7,594,695 | B2 * | 9/2009 | Noonan | A47C 7/66 297/184.11 |
| 8,915,354 | B1 * | 12/2014 | Smith | A45C 11/26 206/6.1 |
| 2014/0374036 | A1 * | 12/2014 | Chen | E06B 9/90 160/313 |
| 2015/0047792 | A1 * | 2/2015 | Lukosiunas | E06B 9/34 160/84.05 |
| 2019/0010756 | A1 * | 1/2019 | Lin | E06B 9/60 |

* cited by examiner

RETRACTABLE NECKLACE TRAVEL SCROLL

FIELD OF THE INVENTION

The present invention relates, generally, to receptacles for jewelry, such as necklaces, and more particularly, to receptacles which can be rolled into a scroll to prevent the contained items from becoming tangled and entangled.

BACKGROUND OF THE INVENTION

Articles of jewelry, such as necklaces, are difficult to store and transport because even the chain of a a single item can become tangled. Multiple necklaces are even more problematic, as not only the chain of each necklace can become tangled, but the chains of multiple necklaces can become intertangled. A number of devices have been created to articles of jewelry, such as necklaces and bracelets tangle free while transporting them.

U.S. Pat. No. 10,098,480 B1 to Michela N. DeLuca discloses a non-slip jewelry holder having a first and second layer of a non-slip material located adjacent to each other, wherein the first layer includes a plurality of slits located along the first layer; at least one set of adjustable prongs located between the first and second layers, wherein the set of adjustable prongs includes two prongs located a distance from each other, wherein each of the two prongs include a prong retainer, a prong edge operatively connected to the prong retainer, a prong extension having a first end and a second end such that the first end of the prong extension is operatively connected to the prong edge and a prong slot such that the second end of the prong extension is operatively connected to the prong slot; and a jeweler holder fastener to retain the non-slip jewelry holder in a rolled-up form.

U.S. Pat. No. 9,833,051 to Colleen Chinlund discloses a jewelry storage case which includes a spool having a cylindrical hollow body, a first slot at a first end, and a second slot at a second end. The first and second slots are sized and shaped to receive an end of a jewelry item that is secured to the spool. The spool may be disposed in a base and protected by a cover that is removably attached to the base.

U.S. Pat. No. 9,491,995 to Margaret Sichi discloses a jewelry storage, display or travel case having an upper planar layer of a pliable plastic sheet which clings to a lower plastic sheet for insertion of delicate jewelry there between. The lower plastic sheet is stiffened by a backing layer so that the upper pliable layer can be peeled away without disturbing the support provided to delicate jewelry stored within. The laminate of the 2 plastic sheets and the backing layer is optionally flexible enough to roll for packing, or can be stiffer for forming rigid pages in a binder or packing in a strong stack. The case can have transparent plastic pliable sheets on opposite side of the backing layer, each being capable being peeled away from a lower plastic sheet laminated to opposing sides of the backing layer.

U.S. Pat. No. 9,326,577 to Seda Gaspari discloses a fine jewelry holder adapted for storing, displaying, and transporting fine jewelry and especially for necklaces and bracelets. The jewelry holder having a plurality of snap-strips, with at least two snap-strips having male type snaps arranged thereon and a plurality of the snap-strips having female type snaps arranged thereon. The two male type snap-strips stitched to a base in mutually parallel positions spaced apart and with male snaps facing away from the base. A plurality of parallel, spaced apart female type snap-strips stitched to each said male snap-strip with one end of each female snap-strip stitched under one of the male snap-strips and positioned orthogonal thereto; and pairs of the female snap-strips extending from the opposing male snap strips in mutual collinear convergence and with female snaps facing away from the base.

U.S. Pat. No. D734,037 to Jennifer Eckstein Coon discloses a tubular necklace carrier having a pair of spaced-apart parallel notches which are cut about half way through the cylindrical wall of the carrier.

U.S. Pat. No. 7,789,224 to Patricia Mary Diamond discloses a jewelry chain holder is which is adapted to receive and hold a plurality of jewelry chains of varying lengths such that the chains will not be entangled or twisted in the storage container.

U.S. Pat. No. 6,012,571 to Howard N. LaPierre discloses a jewelry carrier for storing and transporting chain-like jewelry such as necklaces. The carrier comprises a base, a plurality of pegs arranged in peg rows extending from the base, and a plurality of hook carriers, each having two or more hooks. The hook carriers are each aligned with one of the peg rows. The hook carriers are capable of slidable movement toward and away from its corresponding peg row. The hook carriers are spring biased away from the pegs. Necklaces are initially placed around one of the pegs in one of the peg rows. The corresponding hook carrier is slid toward that peg row, and the necklace is placed around one of the hooks. The hook carrier is then released, the hook carrier slides away from the peg row, thereby tensioning the necklace between the hook and the peg.

U.S. Pat. No. 5,833,052 to Patricia Mary Diamond discloses a jewelry chain holding device, which includes a container. A jewelry chain holder insert is dimensioned for slidably coupling within the container. The jewelry chain holder insert is adapted for receiving a jewelry chain in a folded orientation therein.

U.S. Pat. No. 5,425,444 to Frances V. Chapman discloses a necklace holder which includes a supporting base and opposed tees mounted on the base and urged apart by a compression spring. The opposed tees each include a crossbar with a lengthwise channel. The tees are urged apart against a necklace looped around the crossbars and within the channels.

U.S. Pat. No. 5,211,284 to Gail H. Parks discloses a jewelry chain holder which includes two tube-like structures joined together by a common partition wall in a side-by-side disposition, each tube defining a channel-like cavity and a longitudinal slit running the full tube length and preferably located on a portion of the tube somewhat opposite from the partition wall. The length of each tube approximates half the total chain length, and the cross-section of each cavity is sufficiently large to contain a cross-section of the chain within. Preferably the tube-like structures are transparent and made of a slightly resilient material that permits a user to force approximately half the chain length into each cavity through the longitudinal slit. The result is that substantially the entire chain is maintained in a stretched out disposition within the two cavities, the partition wall separating the two chain halves. So held, the chain is visible from 360.degree. and is protected by the exterior of the tube-like structures from dust, scratching and other damage. Because the chain halves are held slightly taut, the chain is not free to tangle and kink, despite the orientation of the holder. The disclosed holder is inexpensively constructed, is light weight, and may be used to display or maintain a jewelry chain during storage, transportation and the like.

U.S. Pat. No. 5,129,510 to Alan H. W right discloses a necklace support apparatus for supporting a necklace in a mildly tensioned state; wherein, the apparatus comprises a housing member having first and second support members; wherein, at least one of the support members is moveable relative to the other support member; so that the necklace can be looped over and be captively engaged between the two support members and.

U.S. Pat. No. 5,121,833 to Susan L. Lindsay and Robert F. Lindsay discloses a device for easing selection of, securely storing, protecting, displaying, and transporting items that can be attached to its woven face, loops, fastener ended straps, or contained within its compartment. The device is flexible, rectangular, and planar when unrolled and hangs suspended from a cord and a stiff bar with end caps. It has a front piece with a surface with a plurality of apertures and is interspersed with various attachments for articles such as jewelry, and including a detachable mirror and a detachable timepiece. Behind this layer is the back piece composed of fabric enclosing padding. The facing surfaces between the pieces of the front and back are coated with a frictionable substance that will contribute to holding the items fastened to the device and prevent them from moving around. When items are attached to the device, those not contained within a compartment will be displayed in an attractive manner that will be enhanced by the design of the device. When the device is rolled up and securely fastened, the contents within are protected from each other and external forces by the padded layer and rigid bar and are prevented from slipping out by the friction caused by a combination of the pressure from the compressed padding and the friction enhancing coated surfaces between the layers. Because the device is continuous in a circular manner as seen from the Y axis, it forms a trough at the bottom, any items such as earring clasps that may fall during attachment will be easily retrieved from the device. Attached to the bottom interior is a sleeve like slipcase, with a center cinch strap and a closure at its open end, that slides over the device and keeps its contents tightly contained and additionally protected when prepared for travel. This device offers economy of space, ease of conversion from display to travel mode and back again, and ease of access and selection of its contents when displayed.

U.S. Pat. No. 4,930,635 to Calvin J. Hotchkiss and Nancy E. Hotchkiss discloses a soft, book-like container for storing and displaying items of jewelry. The container generally comprises a pliable, foldable cover element made from a first, durable material and a page-like section made from a second, fabric material. The page-like section is affixed along one side edge to the cover element and is arranged relative to the cover element to permit folding of the cover element about the page-like fabric section to contain the page-like fabric section, moreover, the page-like fabric section comprises a fabric loop having exterior jewelry display surfaces and inner mounting cap surfaces.

U.S. Pat. No. 4,735,246 to Susan Niehous discloses a rectangular base cloth that is provided with one or more cross hands. A plurality of small spaced-apart strips have a first end secured adjacent the band lower edge with an opposing free end being releasably attachable to the band. When attached to the band the strips form a series of closed loops for holding small objects such as necklaces, rings and bracelets. A closable lower pocket is provided that includes an exterior flap. The flap is readily piercable to accomodate objects having pin attachment means. The base cloth may include side covers and the overall assembly can be rolled upon itself for compact storage and easy transport. The base cloth includes connector elements for hanging and display and for securing the receptacle in its roll form.

U.S. Pat. No. D284,331 to Sandra S. O'Toole discloses a necklace caddy shaped like a cylindrical spool having a pair of flanges attached to opposite ends of a cylindrical member and a U-shaped strap connecting the two flanges.

U.S. Pat. No. 2,312,009 to Arthur J. Traumüller, Sr. discloses a display rack for jewelry, such as necklaces, in which a pair of parallel, spaced-apart rods are rotatably mounted within spaced-apart journals. Each rod is eq uipped with a crank at one end thereof and can be rotationally biased with a coil spring by turning the crank. A jewelry item, such as a necklace can be stretched between the two rods and held in place by the spring biasing.

U.S. Pat. No. 1,485,646 to Henry Traumüller and Arthur J. Traumüller discloses a device for displaying jewelry such as watch bands, bracelets, wrist bands and watches under tension between a series of two hooks secured to a board, one of which is spring biased toward an upper edge of edge of the board.

In spite of the abundance of jewelry mounting, storage and transporting devices, there is yet a need for a device which more conveniently stores jewelry items, such and necklaces, and enables them to be transported while traveling without the items becoming tangled.

SUMMARY OF THE INVENTION

The present invention provides a necklace travel scroll, which may also be described as a display, storage and carrying case for jewelry items, such as necklaces. Such items are likely to become easily tangled and entangled with other similar items if they are not maintained under conditions that prevent single necklaces from tangling and knotting and kept apart from one another so that they do not become entangled.

The necklace travel scroll includes an inverted-V-shaped frame, a spring-loaded tube rotatably suspended between the frame, a rectangular cloth sheet attached along one edge to the tube, with an opposite edge wrapped around a weighted rod to form a pocket on a front surface of the cloth sheet. A plurality of equally-spaced jewelry hanging hooks are secured to an upper portion of the cloth sheet. One end of a necklaces is attached to a single hanging hook. The opposite end of the necklace is tucked into the pocket. Although the current embodiment of the invention has eleven such hanging hooks, that number can be augmented or reduced as desired. Much like a roll-up blind, by tugging on the weighted rod at the bottom of the pocket, the roll-up mechanism is released and spring loading causes the tube to wind up the cloth sheet until the weighted rod contacts opposite ends of the inverted-V-shaped frame. Multiple necklaces can be transported in this rolled-up configuration with little or no concern that the necklaces will be tangled or entangled with one another. A chain is secured to the center of the frame and a closet clothes rod hook is attached to the free end of the chain. This enables the necklace travel scroll to be hung on a closet clothes rod in either a retracted (rolled-up) configuration or an extended (unrolled) configuration. By pulling down on the weighted rod, the cloth sheet can be extended to display the stored necklaces. The tube automatically locks at the distance it is unrolled. Pulling down again on the weighted rod will cause the cloth to once again roll up around the tube.

BRIEF DESCRIPTION OF THE DRAWINGS

While the present invention is described with particularity in the claims, which are annexed hereto and form a part of this specification, a better understanding of the invention can be had by reference to the following detailed description thereof, taken in conjunction with the accompanying drawings in which:

DESCRIPTION OF THE PREFERRED EMBODIMENT

The necklace travel scroll will now be described in detail, with reference to the attached drawing figures.

The present invention provides a necklace travel scroll 100, which may also be described as a storage and carrying case for jewelry items, such as necklaces. Such items are likely to become easily tangled and entangled with other similar items if they are not maintained under conditions that prevent single necklaces from tangling and knotting and kept apart from one another so that they do not become entangled.

Figure 1:
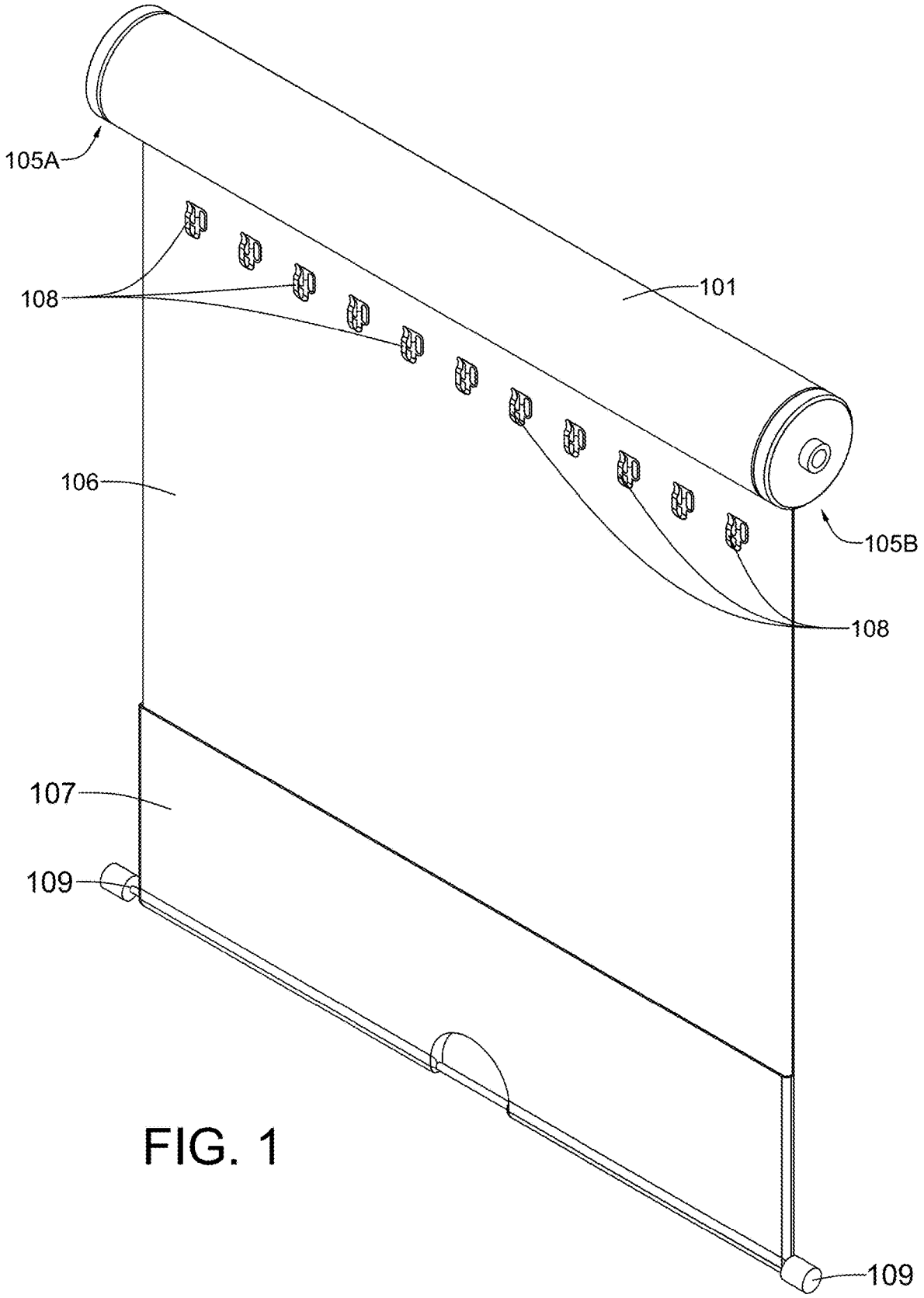
FIG. 1 is an isometric view of the retractable necklace travel scroll.

Referring now to drawing FIG. 1, the necklace travel scroll 100 includes an inverted shallow-V-shaped frame 101, a spring-loaded tube 122 rotatably suspended between the frame 101, a rectangular cloth sheet 106 attached along one edge to the tube, with an opposite edge wrapped around a weighted rod 109 to form a pocket 107 on a front surface of the cloth sheet 106. A plurality of equally-spaced jewelry hanging hooks 108 are secured to an upper portion of the cloth sheet 106. One end of each necklace is attached to a single hanging hook 108. The opposite end of the necklace is tucked into the pocket 107. Although the current embodiment of the invention has eleven such hanging hooks, that number can be augmented or reduced as desired. Much like a roll-up blind, by tugging on the weighted rod at the bottom of the pocket, the roll-up mechanisms 105A and 105B are released and spring loading causes the tube to wind up the cloth sheet until the ends of the weighted rod 109 contacts opposite ends of the inverted-V-shaped frame 101. Multiple necklaces can be transported in this rolled-up configuration with little or no concern that the necklaces will be tangled or entangled with one another. A chain 103 is secured to the center of the frame 101 and a closet clothes rod hook 104 is attached to the free end of the chain 103. This enables the necklace travel scroll to be hung on a closet clothes rod in either a retracted (rolled-up) configuration or an extended (unrolled) configuration. By pulling down on the weighted rod 109, the cloth sheet 106 can be extended to display the stored necklaces. The tube 102 automatically locks at the distance it is unrolled. Pulling down again on the weighted rod 109 will cause the cloth sheet 106 to once again roll up around the tube 102.

Figure 2:
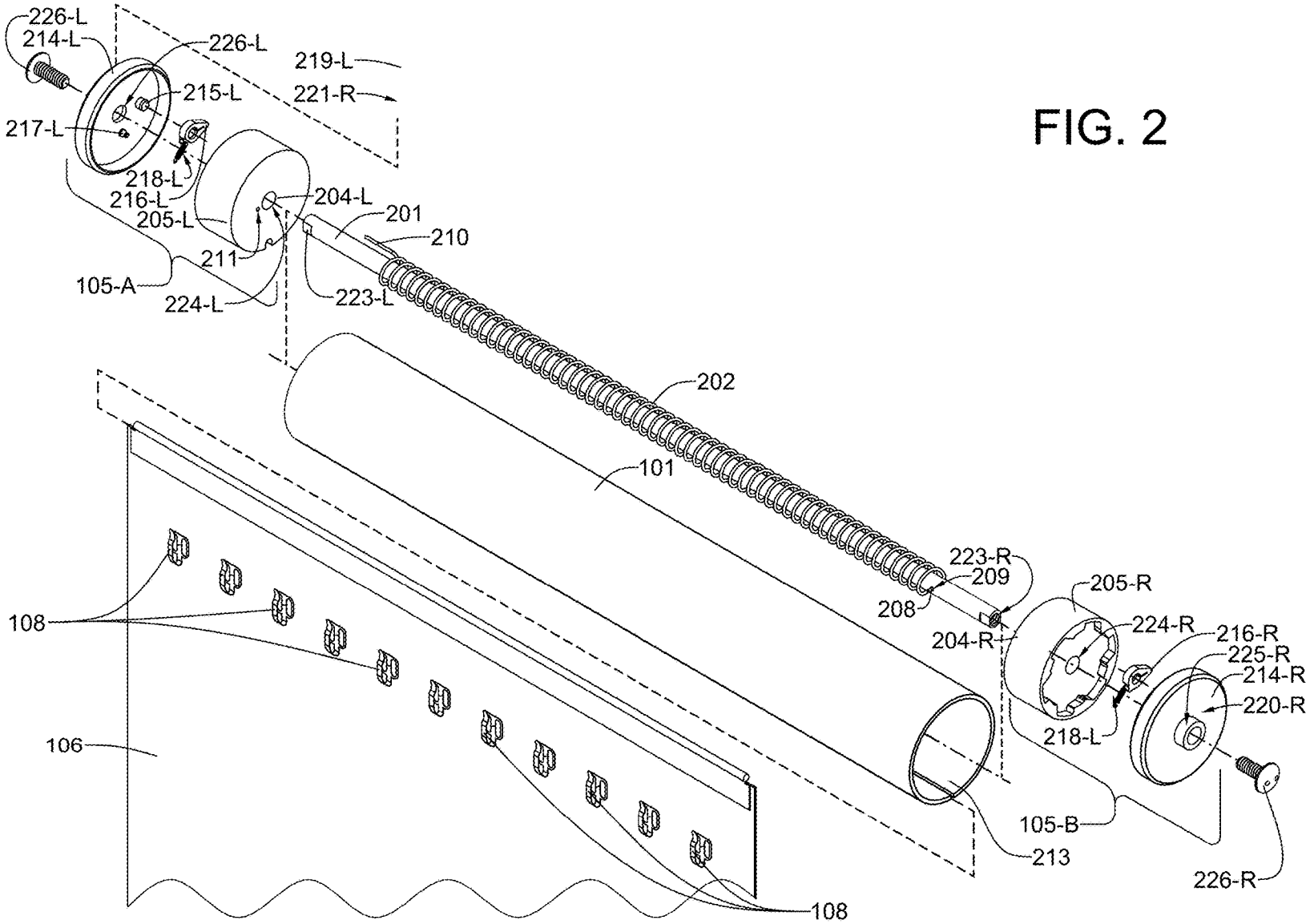
FIG. 2 is an exploded isometric view of the retractable necklace travel scroll.
Figure 3:
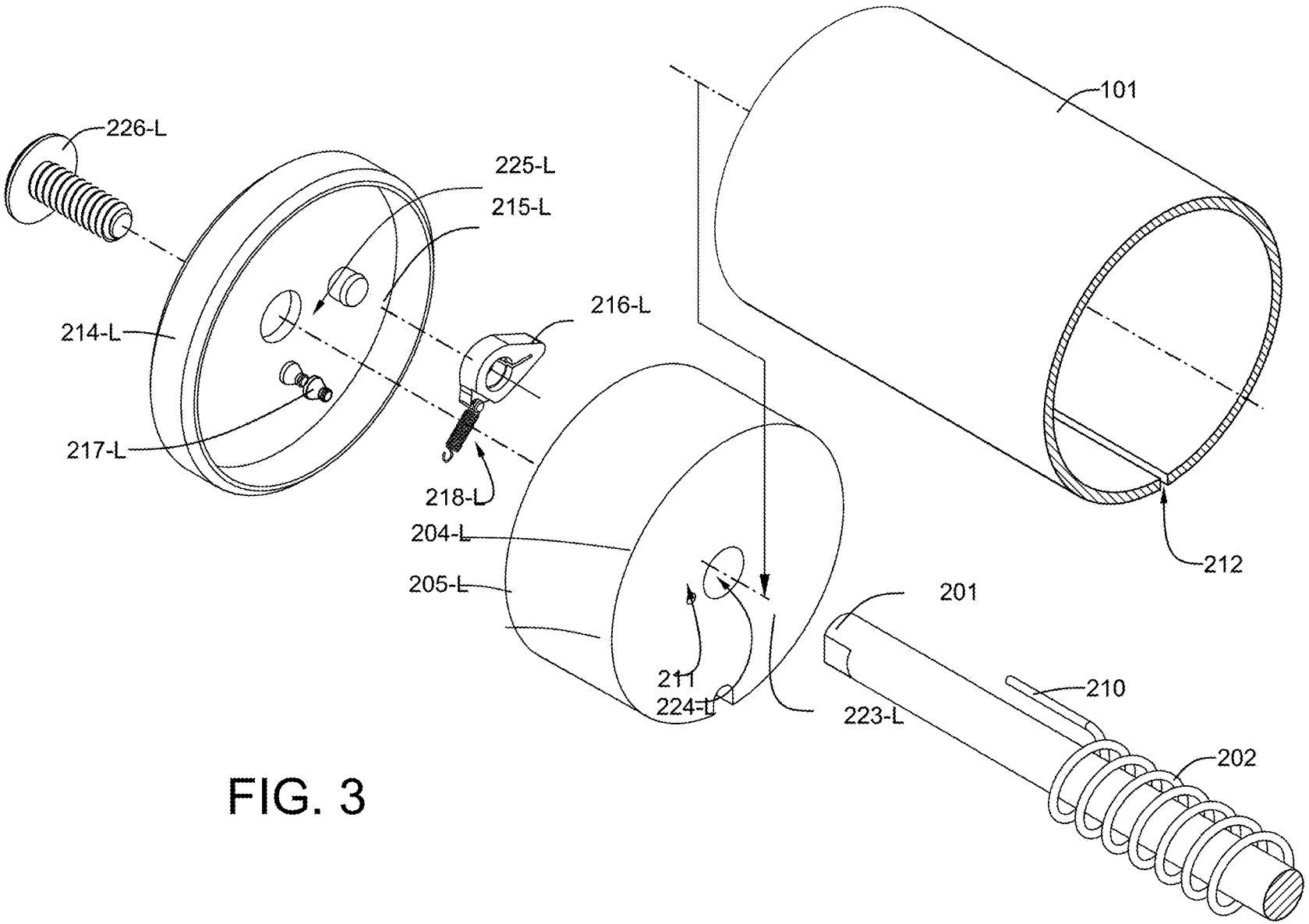
FIG. 3 is an enlarged view of the left side of the exploded view of the retractable necklace travel scroll of FIG. 2.
Figure 4:
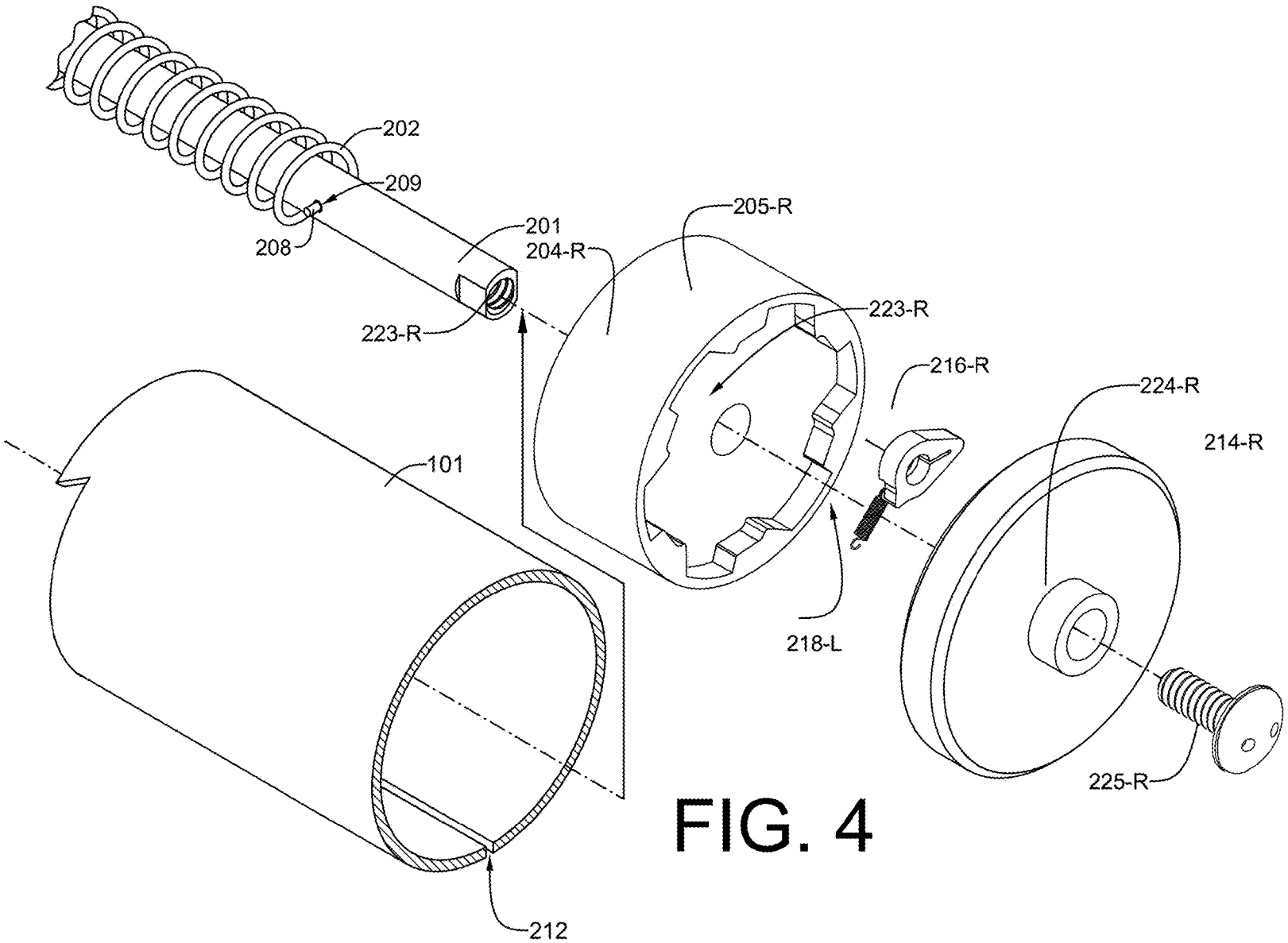
FIG. 4 is an enlarged view of the right side of the exploded view of the retractable necklace travel scroll of FIG. 2.

Referring now to FIGS. 2, 3 and 4, the necklace travel scroll 100 is shown inan exploded view. The tube 102 slips over a support rod 201, which is inserted through a coil torsion spring 202. A left end of the tube 102 is affixed to a cylindrical extension 204-L on a left cogwheel 205-L with a first rivet 203-A, that passes through punched aperture 206-L in the tube 102 and is secured within a drilled aperture 207-L in the cylindrical extension 204-L. A right end 208 of coil torsion spring 202 is anchored within a transverse aperture 209 in the support rod 201, while a left end 210 of the coil torsion spring 202 is anchored within an aperture 211 in the cylindrical extension 204-L of the left cogwheel 205L. Before the right end of the tube 102 is affixed to a cylindrical extension 204-R on a right cogwheel 205-R with a second rivet 203-B, that passes through punched aperture 206-R in the tube 102 and is secured within a drilled aperture 207-R in the cylindrical extension 204-R, the cloth sheet 106 is inserted within the slot 212 in the tube 102 with the bead 213 at the top of cloth sheet 106 being positioned inside the tube 102. The left cogwheel 205-L and the right cogwheel 205-R are mirror images of one another, with the exception that there need be no aperture eq uivalent to aperture 209 in the cylindrical extension 204-R. The left cogwheel 205-L rotates about the left end of support rod 201, while the right cogwheel 205-R rotates about the right end of support rod 201.

Still referring to FIGS. 2, 3 and 4, a left end cap 214-L provides a pivot pin 215-L for a left pawl 216-L and an anchoring pin 217-L for left pawl spring 218-L. Likewise, a right end cap 214-R provides a pivot pin 215-R for a right pawl 216-L and an anchoring pin 217-R for right pawl spring 218-R (not visible in this view). The right end cap 214-R and the left end cap 214-L are also mirror images of one another. The downward-projecting right end 219-L of the frame 101 fits within a recess 220-R within the right end cap 214-R and prevents the latter from rotating about the support rod 201. Likewise, the downward-projecting left end 219-R of the frame 101 fits within a recess 220-L (not visible in this view) within the left end cap 214-L and prevents the latter from rotating about the support rod 201. It will be further noted that each downwardly-projecting end 219-L and 219-R of the frame 101 is equipped with a generally circular aperture 221-L and 221-R, respectively, having diametrically-opposed flats. The left end 222-L of the cylindrical support rod 202, which is equipped with diametrically-opposed flats 223-L, is inserted through a central aperture 224-L in the cylindrical extension 204-L of left cogwheel 205-L, then through the central aperture 225-L of the left end cap 214-L, and then through the aperture 221-L in the downwardly-projecting left end 219-L of the frame 101, which is secured to the left end 222-LK of support rod 202, which has been axially drilled and tapped to threadably receive a left retaining screw 226-L. Likewise, the right end 222-R of the cylindrical support rod 202, which is also equipped with diametrically-opposed flats 224-R, is inserted through a central aperture 224-R in the cylindrical extension 204-R of left cogwheel 205-R, then through the central aperture 225-R of the left end cap 214-R, and then through the aperture 221-R in the downwardly-projecting left end 219-R of the frame 101, which is secured to the right end 222-R of support rod 202, which has been axially drilled and tapped to receive a right retaining screw 226-R.

Still referring to FIGS. 2, 3 an 4, in order to provide spring tension on the tube 102 so that it will roll up the cloth sheet 106, the weighted rod 109 is removed from the bottom of the cloth sheet 106, and the cloth sheet 106 is wrapped around the tube 102. In order to apply some pretension to the coil torsion spring 202, the bottom edge of the cloth sheet 106 is pulled in a downward direction, thereby partially unrolling it. The free, unrolled portion is then wrapped around the tube 102, maintaining the preload torsion on the coil torsion spring 202. The weighted rod 109 is then reinstalled in the bottom edge of the cloth sheet 106. The extended ends 227-L and 227-R of the weighted rod 109 prevent the tube 102 from rotating and relieving the preload torsion on the coil torsion spring 106.

Figure 5:
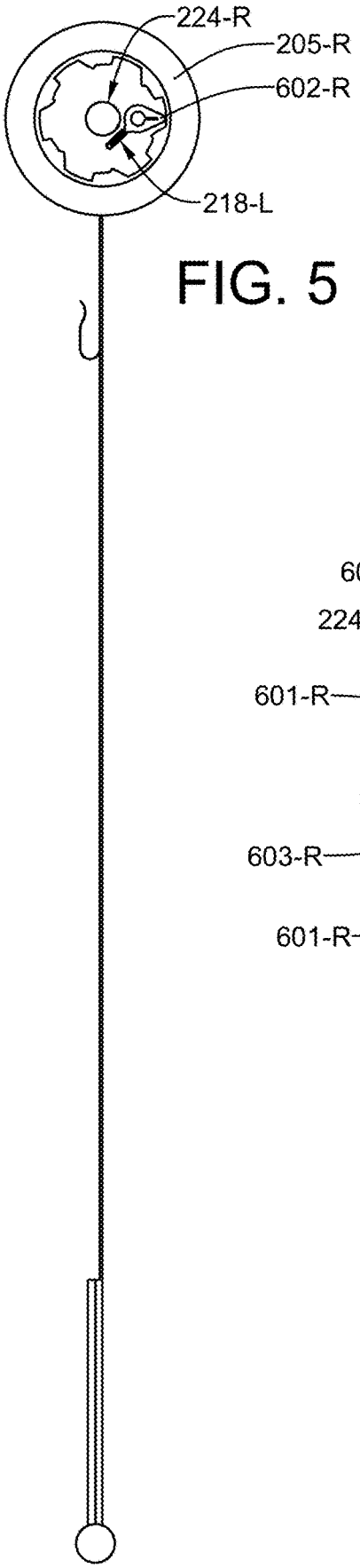
FIG. 5 is a right side elevational view of the retractable necklace travel scroll, with the frame and right end cap removed.
Figure 6:
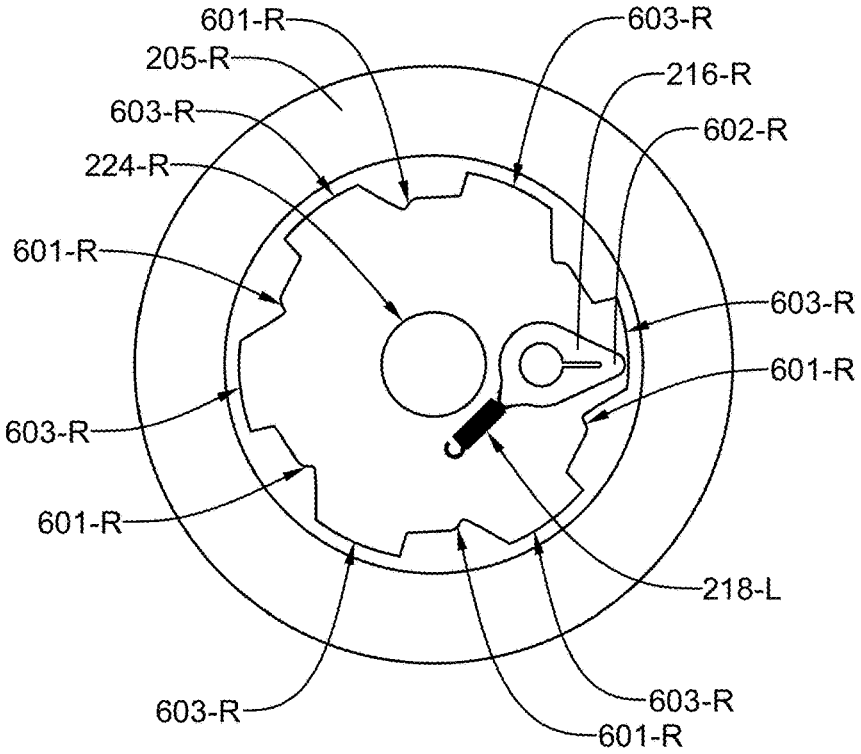
FIG. 6 is an enlarged side elevational view of the retractable necklace travel scroll, with the frame, right end cap and cloth removed.
Figure 7:
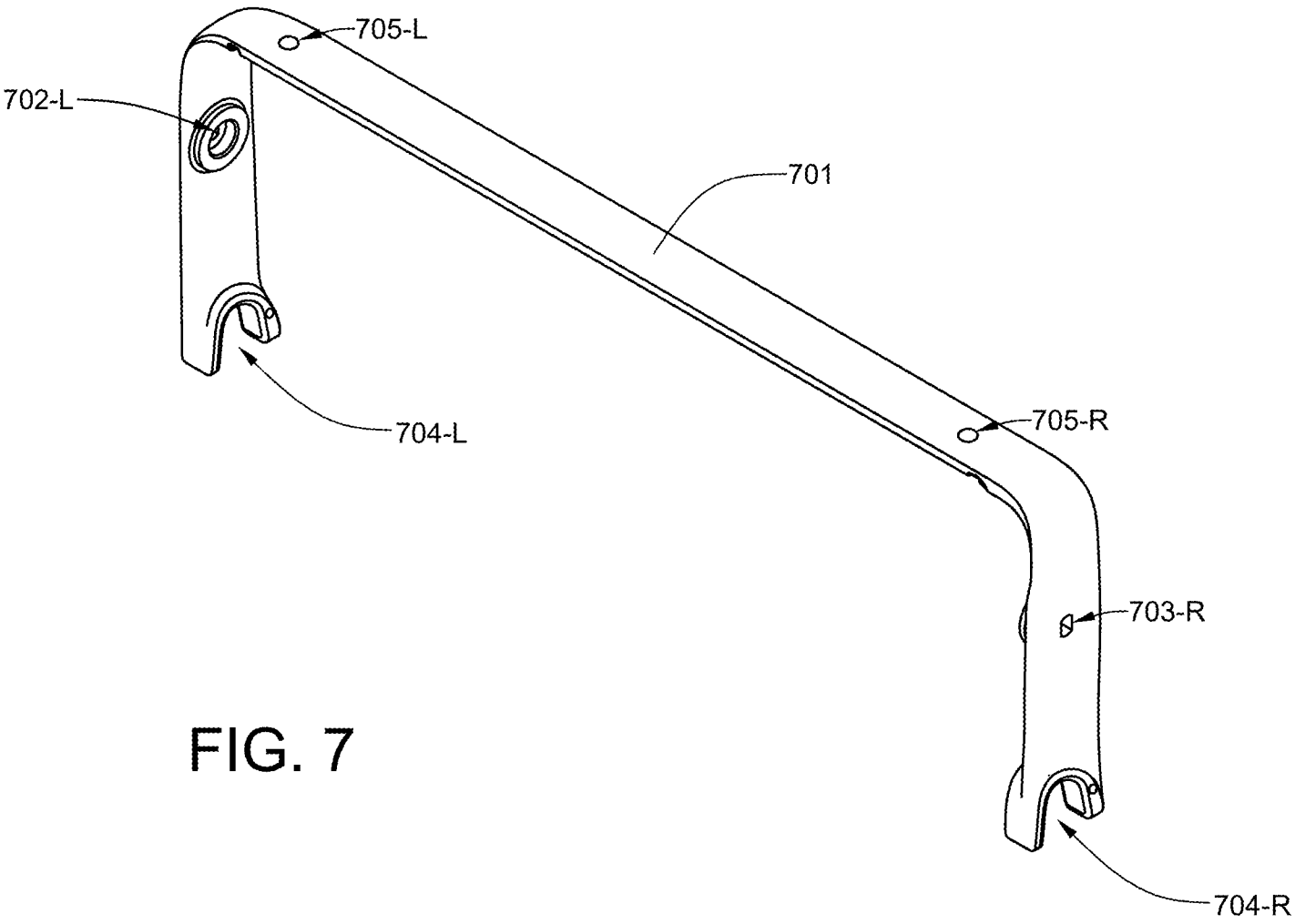
FIG. 7 is an isometric view of the bare frame of the retractable necklace travel scroll.
Figure 8:
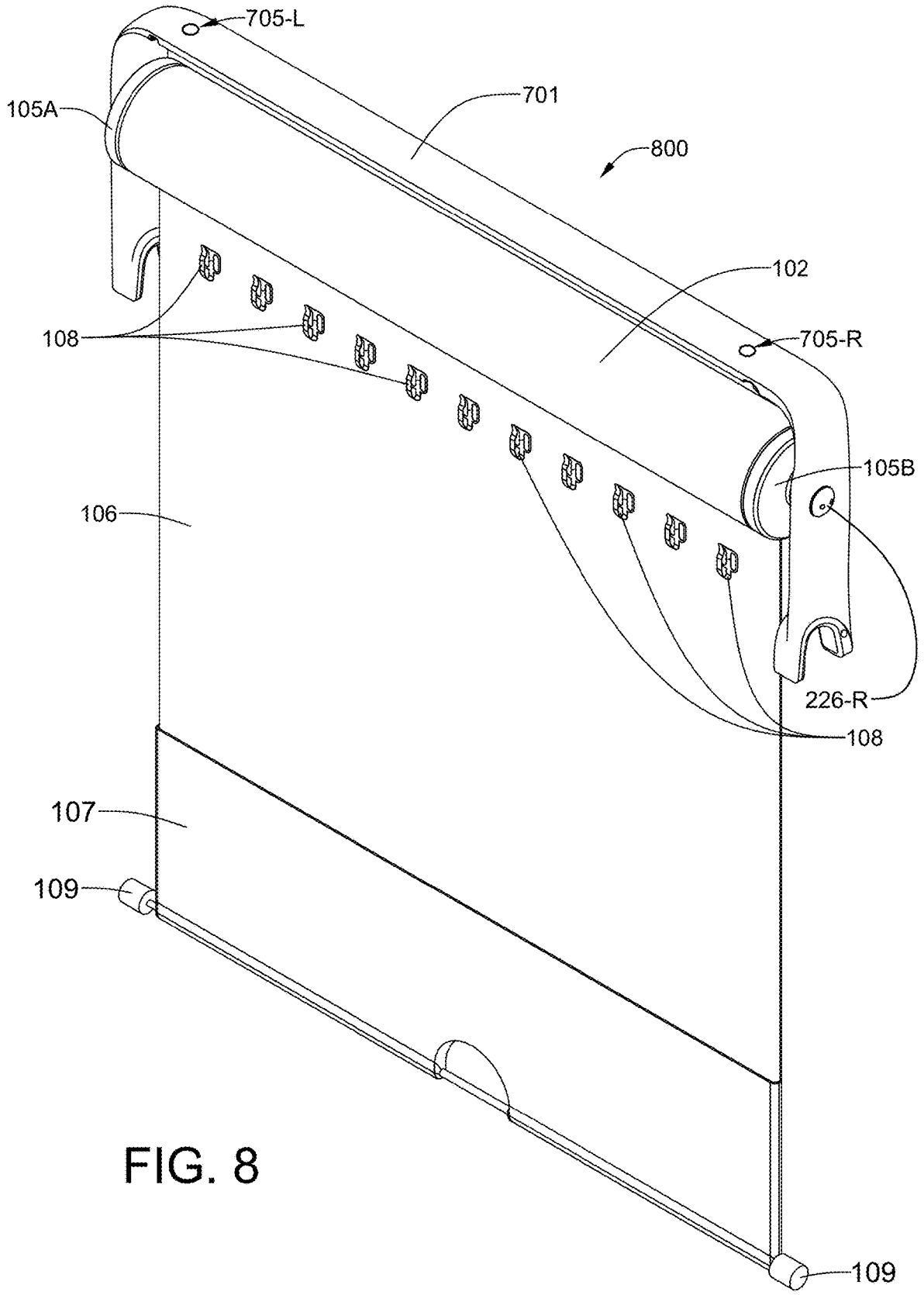
FIG. 8 is an isometric view of the retractable necklace travel scroll, with the cloth extended and the clutch enclosure removed.
Figure 9:
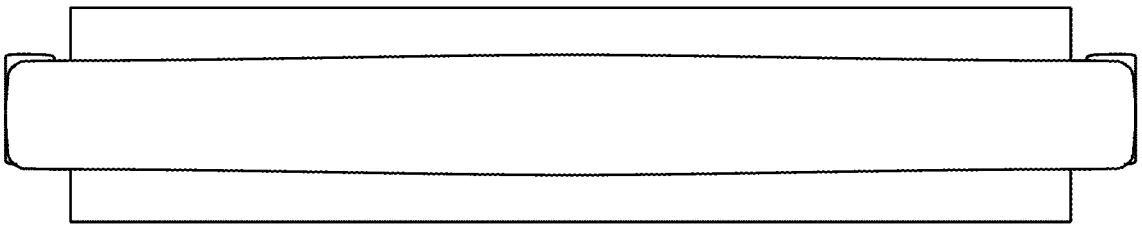
FIG. 9 is a top plan view of the retractable necklace travel scroll, with the cloth retracted and the clutch enclosure removed.
Figure 10:
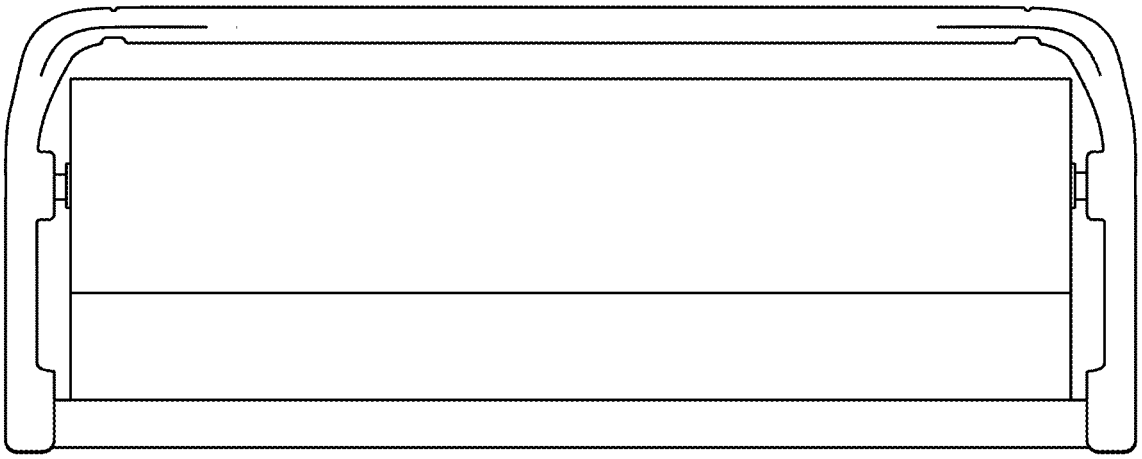
FIG. 10 is is a front elevational view of the retractable necklace travel scroll, with the cloth retracted and the clutch enclosure removed.
Figure 11:
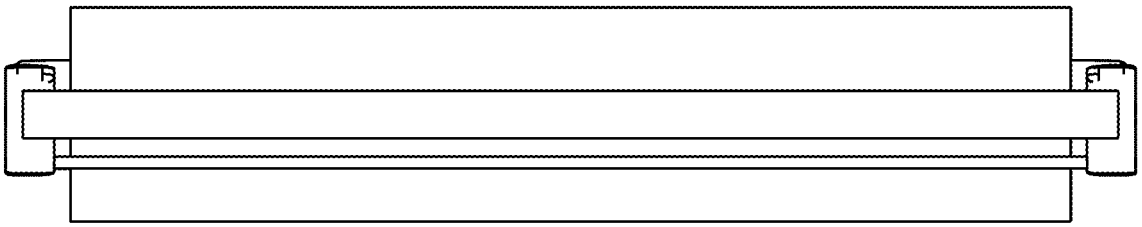
FIG. 11 is a bottom plan view of the retractable necklace travel scroll, with the cloth retracted and the clutch enclosure removed.
Figure 13:
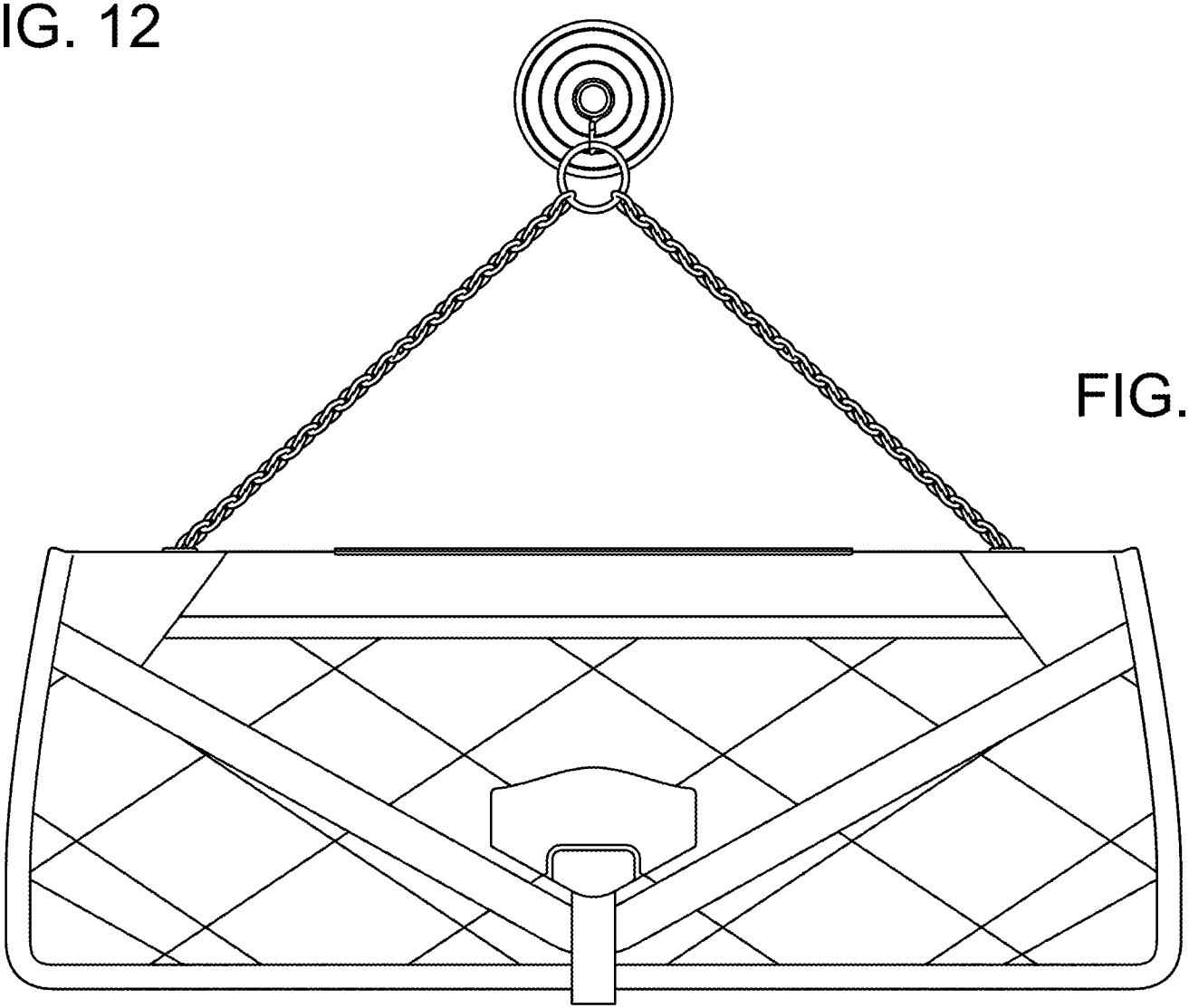
FIG. 13 is a front elevational view of the fully-assembled retractable necklace travel scroll.
Figure 12:
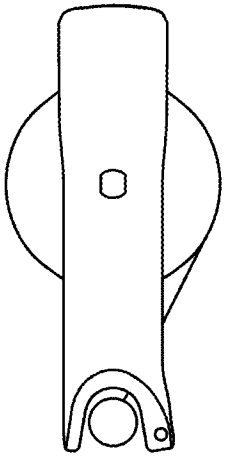
FIG. 12 is a right side elevational view of the retractable necklace with the clutch enclosure removed
Figure 14:
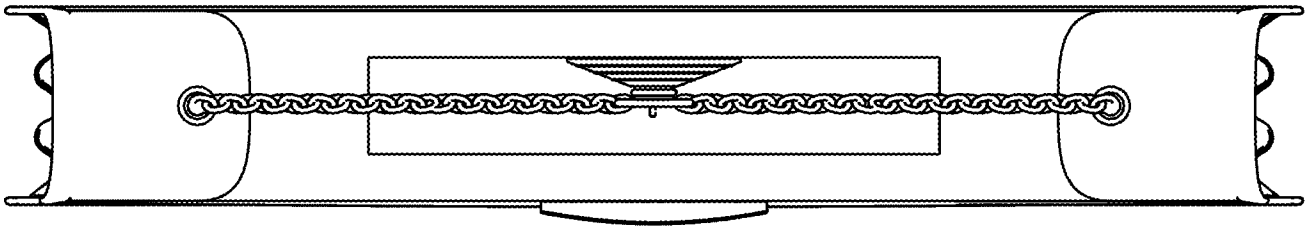
FIG. 14 is a top plan view of the fully-assembled retractable necklace travel scroll.
Figure 15:
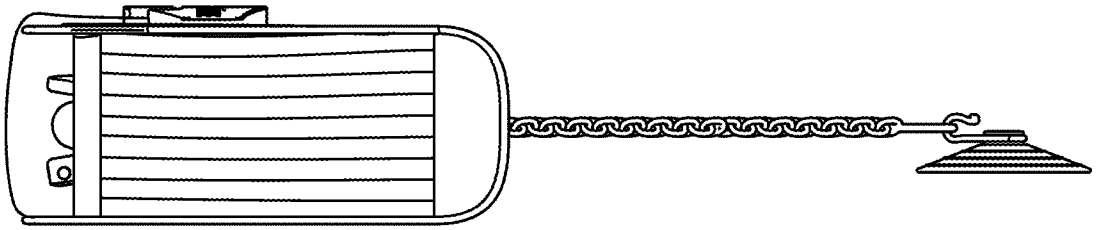
FIG. 15 is right side elevational view of the fully-assembled retractable necklace travel scroll.

Referring now to FIGS. 5 and 6, the right pawl 216-R and the right pawl spring 218-R are positioned with respect to the right cogwheel 205-R just as they would be if the right end cap were covering the right cogwheel 205-R and the pawl 216-R were pivotably installed on the right pivot pin 215-R and the right pawl spring 218-R were anchored on the right anchoring pin 217-R of the right end cap 214-R. The right cogwheel 205-R is torsionally biased, by the coil torsion spring 202, to rotate in a clockwise direction. Six equiangularly-spaced locking ramps 601-R enable the cogwheel to be locked at 60-degree intervals by pulling on the bottom edge of the cloth sheet 106 and rotating the cogwheel 205-R counterclockwise until the nose 602-R of the pawl 216-R just passes one of the ramps 601-R. It should be remembered that the left cogwheel 205-L has mirror image ramps that are axially aligned with those of cogwheel 205-R. If the cogwheel 205-R is released just after passing a ramp 601-R, the cogwheel 205-R will remain stationary. In order to retract the cloth sheet 106, the bottom edge of the cloth sheet 106 is tugged, rotating the cogwheel 205-R counterclockwise, until the pawl enters one of the six recesses 603-R. When the cloth sheet 106 is released, the coil torsion spring 202 will rotate the cogwheel 205-R clockwise, without interruption, until the cloth sheet 106 is completely wound about the tube 102, and the weighted rod 109 contacts opposite, downwardly-projecting left and right ends 219-L and 219-R, respectively, of the frame 101, thereby preventing any further detensioning of the coil torsion spring 202.

Although only a single embodiment of the necklace travel scroll 100 has been shown and described, it will be obvious to those having ordinary skill in the art that changes and modifications may be made thereto without departing from the scope and the spirit of the invention as hereinafter claimed.

What is claimed is:

1. A retractable display and storage clutch for necklaces comprising:

a C-shaped frame having right and left downwardly-projecting arms;

a torsion-spring-loaded tube rotatably suspended between the downwardly-projecting arms of the frame;

a cloth sheet attached along one edge to the tube, with an opposite edge attached to a rod, the cloth sheet having one or more jewelry hanging hooks secured to an upper portion of the cloth sheet and from which one or more necklaces or other pieces of jewelry are hangable; and wherein the cloth sheet is configured to alternately be wrapped or wound around the tube or suspended from the tube by pulling down on the rod.

2. The retractable display and storage clutch of claim 1, wherein the cloth sheet incorporates one or more pockets on a front surface thereof adjacent the rod.

3. The retractable display and storage clutch of claim 2, wherein the frame comprises a central portion extending between the right and left downwardly-projecting arms.

4. The retractable display and storage clutch of claim 3, wherein at least one pocket of the one or more pockets comprises an open side that faces towards the central portion of the frame.

5. A retractable display and storage clutch for necklaces comprising:

a C-shaped frame having first and second opposing downwardly-projecting ends;

a spring-loaded tube rotatably suspended from the first and second opposing downwardly-projecting ends of the frame; and a sheet attached along a first edge to the tube, the sheet having one or more jewelry hanging hooks secured to an upper portion thereof and from which one or more necklaces or other pieces of jewelry are hangable, wherein the sheet is configured to be alternately wrapped or wound around the tube or suspended from the tube, and wherein the spring-loaded tube is configured to rotate in response to a force applied to the sheet, resulting in the sheet automatically retracting and being wrapped or wound around the tube.

6. The retractable display and storage clutch of claim 5, wherein the sheet includes one or more pockets on a front surface thereof adjacent a second edge thereof, the second edge being opposite the first edge.

7. The retractable display and storage clutch of claim 6, wherein at least one pocket of the one or more pockets comprises an open side that faces towards the one or more jewelry handing hooks.

* * * * *